US005355934A

United States Patent [19]

Uozumi et al.

[11] Patent Number: 5,355,934

[45] Date of Patent: Oct. 18, 1994

[54] LOW PRESSURE CASTING APPARATUS

[75] Inventors: Minoru Uozumi, Aichi; Mituyoshi Sato, Toyota; Kunio Shimizu, Toyota; Masao Nakayama, Toyota, all of Japan

[73] Assignee: Toyota Jidosha Kabushiki Kaisha, Toyota, Japan

[21] Appl. No.: 93,585

[22] Filed: Jul. 19, 1993

[30] Foreign Application Priority Data

| | | | |
|---|---|---|---|
| Jul. 22, 1992 | [JP] | Japan | 4-216425 |
| Oct. 20, 1992 | [JP] | Japan | 4-307671 |
| Nov. 5, 1992 | [JP] | Japan | 4-322474 |

[51] Int. Cl.[5] ..... B22D 18/06

[52] U.S. Cl. ..... 164/255

[58] Field of Search ..... 164/255, 63, 119, 306

[56] References Cited

U.S. PATENT DOCUMENTS

| | | | |
|---|---|---|---|
| 5,088,546 | 2/1992 | Greanias et al. | 164/255 |
| 5,230,379 | 7/1993 | Voss | 164/255 |

FOREIGN PATENT DOCUMENTS

| | | | |
|---|---|---|---|
| 0356624 | 5/1989 | European Pat. Off. . | |
| 3925373A1 | 1/1989 | Fed. Rep. of Germany . | |
| 58-196161 | 11/1983 | Japan | 164/63 |
| 60-118365 | 6/1985 | Japan . | |
| 61-95761 | 5/1986 | Japan . | |
| 61-135470 | 6/1986 | Japan | 164/306 |
| 61-195770 | 8/1986 | Japan | 164/63 |
| 62-254958 | 11/1987 | Japan . | |
| 63-71959 | 5/1988 | Japan . | |
| 63-84757 | 8/1988 | Japan | 164/306 |
| 63-127734 | 8/1988 | Japan . | |
| 63-50058 | 12/1988 | Japan . | |
| 2-148769 | 12/1990 | Japan . | |
| 3-71969 | 3/1991 | Japan . | |
| 4351265 | 12/1992 | Japan | 164/306 |

*Primary Examiner*—P. Austin Bradley
*Assistant Examiner*—Erik R. Puknys
*Attorney, Agent, or Firm*—Oliff & Berridge

[57] ABSTRACT

A suction casting apparatus is disclosed, which comprises a ventilating casting die, a chamber box and a surface peat for supporting the casting die and chamber box. The surface plate has a a through hole for passing a stalk therethrough, and its surface is formed with grooves which extend from the through hole to an area outside a die mounting area and inside a chamber box mounting area. External air entering through a sealed clearance between the surface plate and the stalk and combustion gas generated from the casting die are quickly led through the grooves into the chamber inner space to be quickly exhausted to the outside.

5 Claims, 6 Drawing Sheets

LOW PRESSURE CASTING APPARATUS

BACKGROUND OF THE INVENTION

1. Field of the Invention

This invention relates to a low pressure casting apparatus, in which a casting die is hermetically surrounded by a vacuum chamber and a surface plate, for casting molten metal sucked into a die cavity evacuated by evacuating the hermetically surrounding space defined by the vacuum chamber and the surface plate.

2. Prior Art

In the low pressure casting, the hermetical space defined by a vacuum chamber and a surface plate has to be communicated with a melting furnace via a stalk, and a seal between the surface plate and the stalk has to be provided. However, thermal deformation of the stalk is inevitable because high temperature molten metal flows therethrough, and it is difficult to provide a satisfactory seal.

Further, the casting die should be gas permeable, and accordingly, it is often made of sand bound by a binder. However, when molten metal is poured into such a sand die, the binder is burnt to generate combustion gas.

When external air enters the hermetical space defined by the vacuum chamber and the surface plate due to breakage of the seal between the surface plate and the stalk or when combustion gas is generated from the casting die, such external air or combustion gas should be prevented as much as possible from entering the cavity. If the external gas or combustion gas is sucked into the cavity, it is trapped in the molten metal to reduce the quality of the casting.

A low pressure casting apparatus provided with means for solving this problem is disclosed in Japanese Utility Model Laid-Open Publication No. 63-71959.

In this low pressure casting apparatus, the surface plate has a box-like shape with the top wall thereof formed with a plurality of gas purging holes for evacuating the chamber therethrough. With this structure, when evacuating the chamber, external gas entering through the sealed clearance between the surface plate and the stalk and also combustion gas generated in the casting die are exhausted together with gas in the chamber through the gas purging holes. Consequently, the external air and the combustion gas are no longer readily sucked into the cavity, thus reducing gas defects in the casting product.

However, with the above prior art surface plate structure, fat and suit contained in the combustion gas are attached to the gas purging hole surfaces, and in long use, the efficiency of exhausting of gas in the chamber is reduced to increase the time required for the evacuation of the chamber. Therefore, it is necessary to clean the gas purging holes periodically. However, the cleaning of the gas purging holes is very time-consuming. Particularly, when leaking molten metal enters and is solidified in the gas purging holes, the cleaning thereof becomes extremely difficult.

SUMMARY OF THE INVENTION

An object of the invention is to make it difficult the low pressure of the external gas entering through the sealed space between the surface plate and the stalk and also combustion gas generated in the casting die into the cavity by leading such external air and combustion gas into the inner space of the chamber to be exhausted together with gas therein, and also to permit ready cleaning of the passage which is necessary to this end.

A feature of the low pressure casting apparatus according to the invention resides in a surface plate, which has a through hole for passing a stalk for leading molten metal to the casting die, and the surface of which is formed with grooves extending from the through hole to an area outside a die mounting area.

With the grooves formed in the surface of the surface plate and extending from the through hole to the area outside the die mounting area, by mounting the casting die on the surface plate, the surface thereof except end portions of the grooves is covered by the bottom of the die, thus forming passages extending from the through hole to the outside of the die.

Thus, external air entering through the sealed clearance between surface of the through hole and the stalk as the chamber is evacuated by an evacuating unit, is led through the passages noted above into the inner space of the chamber. In addition, combustion gas generated in the casting die is led through the passages into the inner space of the chamber. The external air and combustion gas led into the chamber inner space is sucked and exhausted together with gas in the camber by the evacuating unit. Thus, suction of the external gas and combustion gas into the die cavity is made difficult to reduce gas defects in the casting product.

Since the passages noted above are defined by the grooves formed in the surface of the surface plate and the bottom of the casting die, by removing the die from the surface plate, they can be disassembled so that they can be cleaned satisfactorily.

It is possible to obtain the same effects in case where the bottom surface of the casting die is formed with grooves to this end.

DETAILED DESCRIPTION OF THE PREFERRED EMBODIMENTS

Figure 1:
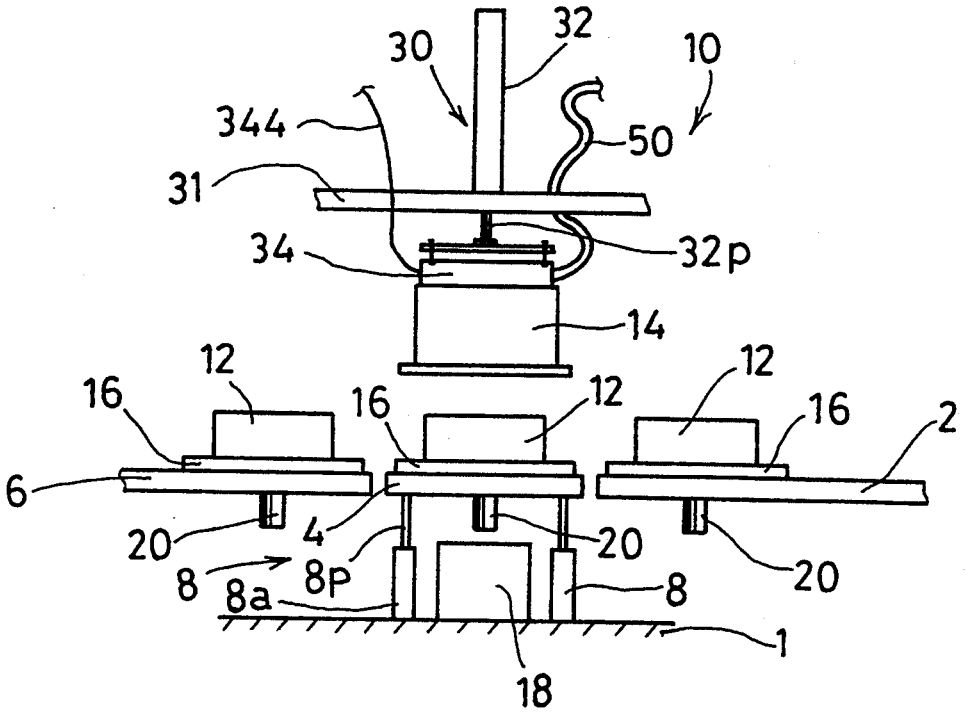
FIG. 1 is a schematic view showing a low pressure casting apparatus according to a first embodiment of the invention.

Now, a low pressure casting apparatus according to a first embodiment of the invention will be described with reference to FIG. 1. FIG. 1 shows the entire low pressure casting apparatus according to the invention.

Designated at 10 is a low pressure casting apparatus according to the invention. As shown, the apparatus comprises a feed-in unit 2 including a conveyer, etc., a positioning unit 4, and a feed-out unit 6. These units 2, 4 and 6 are disposed at the same level and have aligned center lines. A surface plate 16 with a casting die 12 mounted thereon can be smoothly transported from the feed-in unit 2 to the feed-out unit 6.

The surface plate 16 which is transported by the feed-in unit 2 or the like, is a horizontally rectangular iron plate and also serves as a bottom of a vacuum chamber 14 to be described later, and it has a through hole (not shown in FIG. 1) formed at a predetermined position. A cylindrical stalk 20 is inserted in the through hole. The stalk 20 has a top flange which is supported upward by the surface plate 16 and is thus positioned. A seal by a seal member is provided between the surface of the through hole and the stalk 20. On the surface plate 16 is mounted the casting die 12 with its sprue in communication with the top of the stalk 20. The positioning unit 4 is a conveyer which has such a structure that it can position the surface plate 16 with the die 12 thereon to be at its center. Its four corners are supported by four lift cylinders 8. Each lift cylinder 8 has a cylinder body **8*a* having a lower end secured to floor 1 and a piston rod 8*p* having an upper end secured to the bottom of the positioning unit 4. When the individual lift cylinders 8 are driven such that their piston rods 8*p* are extended, the positioning unit 4 is raised to be held to be in level with the feed-in and feed-out out units 2 and 6. When the lift cylinders 8 are driven such as to accommodate their piston rods 8*p*, the positioning unit 4** is lowered down to a predetermined level.

A melting furnace 18 with molten metal stored therein is disposed right beneath the center of the positioning unit 4. Thus, when the positioning unit 4 is lowered by the lift cylinders 8 with the surface plate 16 and so forth positioned on it, the lower end of the stalk 20 mounted in the surface plate 16 is immersed in the molten metal in the melting furnace 18.

Right above the positioning unit 4, a vacuum chamber 14 to surround the casting die 12 and a vacuum chamber lift unit 30 for raising and lowering the vacuum chamber 14 are disposed.

The vacuum chamber lift unit 30 comprises a lift cylinder 32 mounted on a horizontal stationary frame 31 at right angles thereto and a vacuum chamber mounting/demounting unit 34 coupled to a piston rod **32*p* of the lift cylinder 32**.

Figure 3:
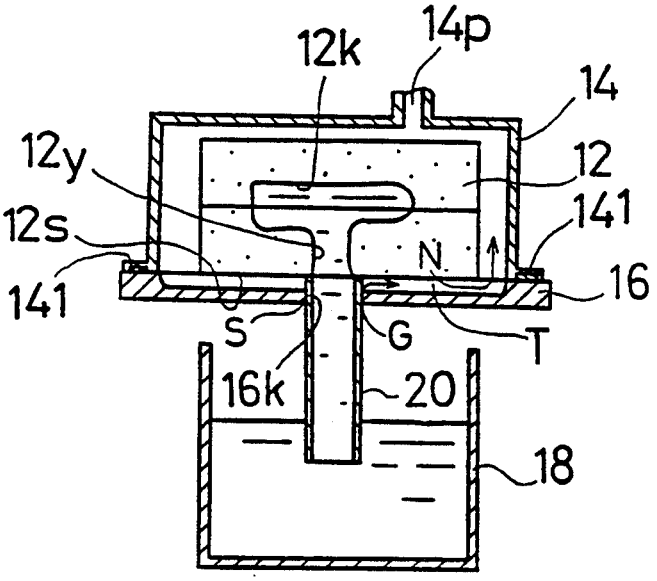
FIG. 3 is a sectional view of the low pressure casting apparatus.

The vacuum chamber 14, as shown in FIG. 3, has a seal member 141 made of heat-resistant rubber mounted on the lower end of its side walls. The inner space of the vacuum chamber 14 is held hermetical while the vacuum chamber 14 is mounted on the surface plate 16. As shown in FIG. 1, to the vacuum chamber 14 is connected an evacuation tubing 50, to which a vacuum pump is connected.

Figure 2A:
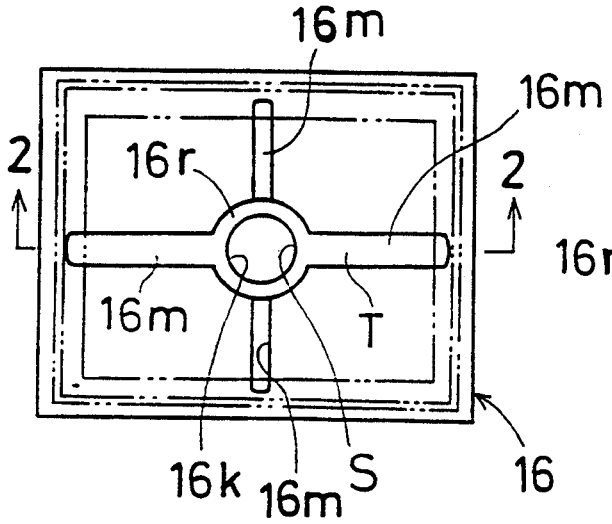
FIG. 2(A) is a plan view showing a surface plate of the first embodiment of the invention.
Figure 2B:
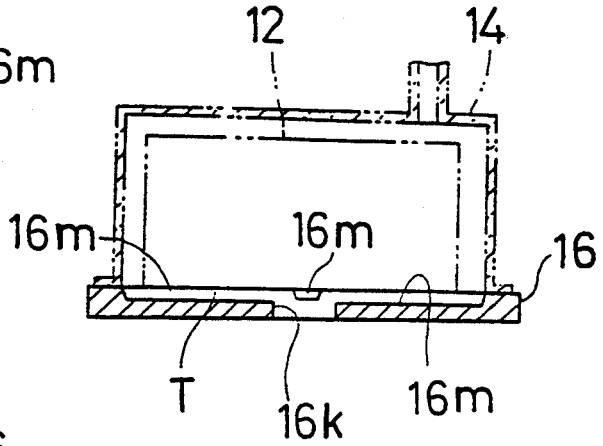
FIG. 2(B) is a sectional view taken along line 2—2 in FIG. 2(A)

FIG. 2(A) is a plan view showing the surface plate 16 in this embodiment, and FIG. 2(B) is a section taken along line 2—2 in FIG. 2(A). FIG. 3 is a sectional view of the low pressure casting apparatus with the surface plate 16 according to this embodiment.

The surface plate 16, as shown in FIG. 3, is a base for supporting the casting die 12 and the vacuum chamber 14 surrounding the die 12. It has a horizontally rectangular shape, and it has through hole **16*k* formed in its central portion. The stalk 20 inserted in the through hole 16*k* leads molten metal to a cavity 12*k* in the casting die 12. A seal by a seal member (not shown) is provided between the stalk 20 and the surface of the through hole 16*k***.

As shown in FIGS. 2(A) and 2(B), the surface of the surface plate 16 is formed with recess **16*r* which is coaxial with the through hole 16*k* and circular in plan view, and is also formed with straight grooves 16*m* extending in four directions from the recess 16*r*. The free ends of the grooves 16*m* are found outside an area in which the casting die 12 is mounted, and inside an area in which the vacuum chamber 14 is mounted. The grooves 16*m*** each have a vertical or flaring end wall as shown in FIG. 2(B).

Thus, when the casting die 12 and the vacuum chamber 14 are mounted regularly on the surface plate 16, a portion of the surface of the surface plate 16 other than the recess **16*r* and free end portions of the grooves 16*m* is covered by the bottom 12*s* of the casting die 12. In consequence, a passage T having a cross shape in plan view is formed such that it extends from the periphery of the through hole 16*k* outwardly of the casting die 12. This passage T communicates the sealed clearance S between the stalk 20 and the through hole 16*k* with the inner space of the vacuum chamber 14**.

The operation of this embodiment of the low pressure casting apparatus using the surface plate 16 will now be described.

First, the stalk 20 is set in the through hole **16*k* of the surface plate 16, and then the casting die 12 is mounted thereon. The casting die 12 is positioned such that its sprue 12*y* is communicated with the stalk 20. Thereafter, the vacuum chamber 14 is mounted on the surface plate 16 with the casting die 12 thereon. A seal member 141 is provided between the lower end of the vacuum chamber 14 and the surface of the surface plate 16. A seal member (not shown) is also provided between the stalk 20 and the surface of the through hole 16*k* in the surface plate 16, thus holding the inner space of the vacuum chamber 14 hermetical. As noted before with the casting die 12 regularly mounted on the surface plate 16, the sealed clearance S between the stalk 20 and the surface of the through hole 16*k* is communicated via the cross-shaped passage T with the inner space of the vacuum chamber 14**.

When the preparations for casting are completed, the surface plate 16 is lowered, and the lower end of the stalk 20 is immersed into the molten metal stored in the melting furnace 18.

Then, the vacuum chamber 14 is evacuated with gas therein exhausted by a vacuum pump (not shown) via the evacuation tubing 50. Consequently, the cavity **12*k* of the casting die 12 is indirectly made vacuum, and molten metal stored in the melting furnace 18 is sucked via the stalk 20 into the cavity 12*k*. The casting die 12 used in this instance is a sand die made of sand bound by an organic binder and is gas permeable. When molten metal is sucked into the cavity 12*k***, combustion of organic binder is caused to generate combustion gas.

When molten metal is sucked into the cavity 12*k*, the stalk 20 is expanded by high heat received from the molten metal, thus resulting in lowering of the seal between the surface of the through hole 16*k* in the surface plate 16 and the stalk 20. Consequently, external air may enter through the sealed clearance S between the surface of the through hole 16*k* and the stalk 20. This external air, however, is led through the passage T into the inner space of the vacuum chamber 14 (as shown by arrow G), and thus it is quickly exhausted together with the gas in the vacuum chamber 14 to the outside. In addition, the high heat of the molten metal causes combustion of resin component of the casting die 12. However, the resultant combustion gas is again led through the passage T into the inner space of the vacuum chamber 14 (as shown by arrow N), and it is quickly exhausted together with the gas in the vacuum chamber 14 to the outside.

Thus, external air and combustion gas are not readily sucked into the cavity 12*k* of the casting die 12, thus reducing gas defects in the casting product.

In addition, since the passage T is defined by the recess 16*r* and grooves 16*m* in the surface of the surface plate 16 and the bottom 12*s* of the casting die 12, it can be readily disassembled by taking out the die 12 from the surface of the surface plate 16 and thus can be cleaned satisfactorily. Further, in the event of leakage of molten metal, the resultant solidified metal can be readily removed.

Figure 4:
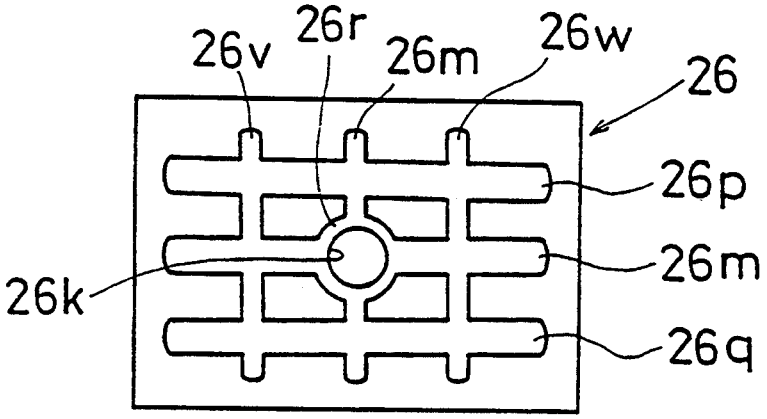
FIG. 4 is a plan view showing a modified surface plate according to the invention to the embodiment of FIG. 2(A)

FIG. 4 is a plan view showing a modified surface plate 26 according to the invention to the embodiment of FIG. 2(A).

The surface plate 26 shown in FIG. 4 basically has the same structure as the surface plate 16 shown in FIG. 2(A) except the number and arrangement of grooves formed in its surface.

More specifically, as shown in FIG. 4, the surface of the surface plate 26, like the previous surface plate 16, is formed with a recess 26 *r* concentric with a through hole 26*k* and circular in plan view, and is also formed with four straight grooves 26 *m*. extending in four directions from the recess 26 *r*. In addition, it is formed with two grooves 26*p* and 26*q* extending parallel to the grooves 26 *m* which extend in the length direction of the surface plate 26 and also two grooves 26*v* and 26*w* extending parallel to the grooves 26*m* which extend in the width direction of the surface plate. The grooves 26 *m*, 26*p*, 26*q*, 26*v* and 26*w* are communicated with one another.

The ends of the grooves 26 *m*, 26*p*, 26*q*, 26*v* and 26*w* are found outside the die mounting area and inside the vacuum chamber mounting area.

With the surface plate 26 shown in FIG. 4, since an increased number of grooves compared to the surface plate 16 shown in FIG. 2(A) and communication of the grooves with one another are provided, improved efficiency of exhausting combustion gas generated in the casting die can be obtained.

Figure 5A:
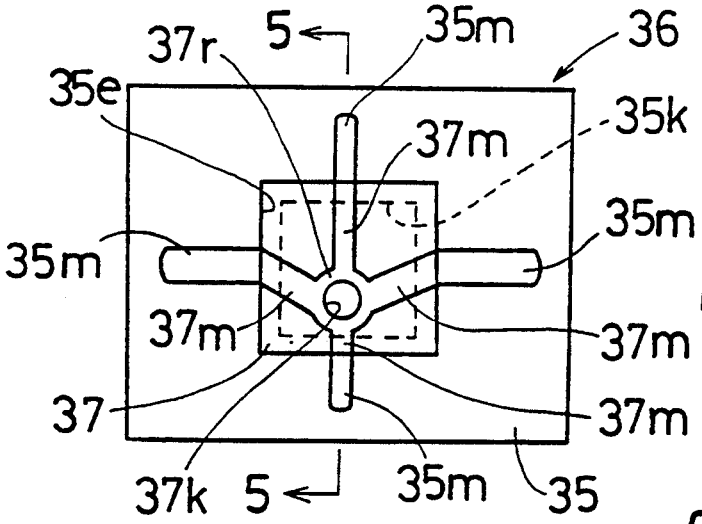
FIG. 5(A) is a plan view showing another modified surface plate according to the invention to the embodiment of FIG. 2(A)
Figure 5B:
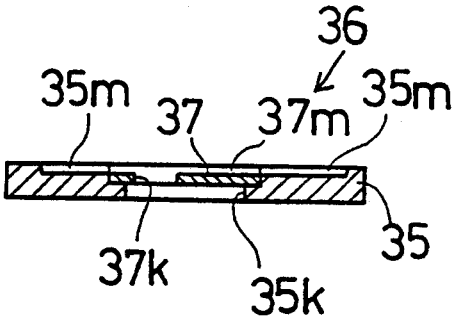
FIG. 5(B) is a sectional view taken along line 5—5 in FIG. 5(A)

FIG. 5(A) is a plan view showing another modified surface plate 36 according to the invention to the embodiment of FIG. 2(A), and FIG. 5(B) is a sectional view taken along line 5—5 in FIG. 5(A).

The surface plate 36 includes a surface plate body 35 and a stalk support 37 supporting the stalk.

The surface plate body 35 has a central square opening 35*k*, and its surface is formed with a recess 35*e* concentric with the opening 35*k* and rectangular in plan view. Its surface is further formed with four straight grooves 35*m* extending from the recess 35*e* in four directions. End portions of the grooves 35*m* are found outside the die mounting area and inside the vacuum chamber mounting area.

The stalk support 37 is a rectangular plate which is fitted in the recess 35*e* formed in the surface of the surface plate body 35. It has a through hole 37*k* formed at a predetermined position for insertion of the stalk. The surface of the stalk support 37, as shown in FIGS. 5(A) and 5(B), is formed with a recess 37*r* concentric with the through hole 37*k* and circular in plan view, and is also formed with four grooves 37*m* extending from the recess 37*r* in four directions. With the stalk support 37 fitted in the recess 35*e* of the surface plate body 35, the grooves 37*m* of the stalk support 37 are communicated with the grooves 35*m* of the surface plate body 35.

The stalk support 37 includes different types in which the through hole 37*k* is formed at different positions and with different sizes to meet different kinds of casting dies. Thus, the apparatus can be used with many different kinds of dies without replacement of the surface plate body 35 but by replacing only the stalk support 37.

When the casting die and vacuum chamber are mounted regularly on the surface plate 36, like the embodiment of FIGS. 2(A) and 2(B), a passage T is defined such that it extends from the periphery of the through hole 37*k* in four directions outward of the casting die. Through the passage T, the sealed clearance between the stalk and the surface of the through hole 37*k* is communicated with the inner space of the vacuum chamber. Thus, external air entering through the sealed clearance between the surface of the through hole 37*k* and the stalk and also combustion gas generated from the casting die are led through the passage T into the inner space of the vacuum chamber to be exhausted together with gas therein to the outside. Thus, the external air and combustion gas are not readily sucked into the die cavity, thus reducing gas defects in the casting product.

In addition, since the passage T is defined by the recess 37*r* and the grooves 35*m* and 37*m* in the surface plate 36, and the die bottom, it can be readily disassembled by removing the casting die from the surface of the surface plate 36 to permit its satisfactory cleaning. Further, in the event of leakage of molten metal, the resultant solidified metal can be readily removed.

Figure 6:
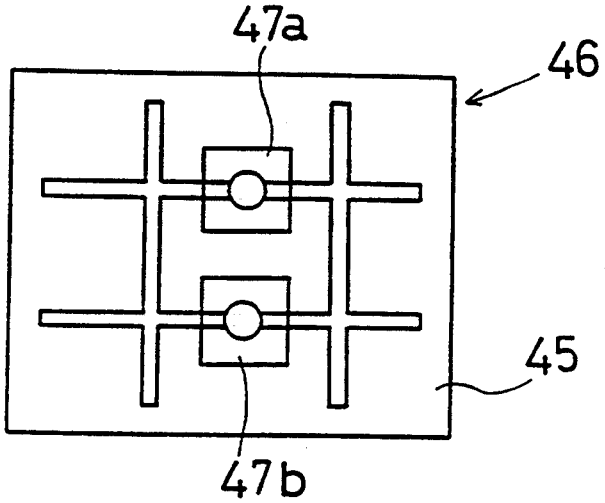
FIG. 6 is a plan view showing a further modified surface plate according to the invention to the embodiment of FIG. 2(A)

FIG. 6 is a plan view showing a further modified surface plate 46 according to the invention to the embodiment of FIG. 2(A).

The surface plate 46 shown in FIG. 6 has basically the same structure as the surface plate 36 shown in FIG. 5(A) except two stalk supports 47*a* and 47*b* are provided in a surface plate body 45.

This specific arrangement can be used with casting dies having a plurality of sprues.

With the surface plates 16, 26, 36 and 46 described above, combustion gas generated in the casting die during casting is led through the passage defined by the surface grooves of the surface plate and the die bottom into the vacuum chamber to be exhausted together with gas therein to the outside. Thus, the combustion gas is not readily sucked into the die cavity, thus reducing gas defects in the casting product.

Further, the passage can be cleaned satisfactorily by taking out the casting die form the surface plate. It is thus possible to hold the flow area of the passage constant at all times, thus permitting stable operation.

Further, in the above embodiments, the top surface of the surface plate is formed with the grooves to lead combustion gas generated from a die lower portion smoothly into the inner space of the vacuum chamber without being sucked into the die cavity. In addition, external air entering through the clearance between the stalk and the surface plate is led into the vacuum chamber inner space without being sucked into the die cavity.

The grooves noted above may be formed in the die bottom as well to obtain substantially the same functions and effects as noted above.

To the vacuum chamber used in the low pressure casting apparatus, tubing from the vacuum pump, a pressure duct for pressure detection, wiring for leakage sensor, etc. are connected. This means that the removal of the vacuum chamber from the lift cylinder 32 noted above for repair, requires removal of the tubing, duct and wiring noted above (hereinafter referred to as tubing and wiring) separately from one another.

However, the tubing and wiring are connected to the vacuum chamber concentratedly in a narrow area thereof. That is, the operation of removal and re-connection of the tubing and wiring is inefficient. Besides, it is impossible to carry out the removal during the operation of the apparatus.

The low pressure casting apparatus of the first embodiment to be described in detail hereinunder, in which a vacuum chamber is lowered by a vacuum chamber lift unit to be fitted on a casting die before making the inner space of the vacuum chamber vacuum to indirectly make the die cavity vacuum so as to suck molten metal into the die cavity, comprises a positioning mechanism for positioning the vacuum chamber to a predetermined position, a mounting/demounting unit mounted on a movable part of the vacuum chamber lift unit and capable of being brought into contact with a predetermined part of the vacuum chamber in a predetermined direction to be engaged with the vacuum chamber, and a lock mechanism for coupling the mounting/demounting unit and the vacuum chamber to each other in the state of engagement of these components.

Relative to the mounting/demounting unit, the ends of the tubing and wiring used in the low pressure casting are positioned, and they are connected to a tubing connector and a wiring terminal provided on the vacuum chamber in a state of the mounting/demounting unit coupled by the lock mechanism to the vacuum chamber.

In this embodiment, when mounting the vacuum chamber on the movable part of the vacuum chamber lift unit, the vacuum chamber is positioned to a predetermined position by the positioning mechanism. In this state, the movable part of the vacuum chamber lift unit is lowered to bring the mounting/demounting unit mounted on the movable part into contact with the predetermined vacuum chamber part in a predetermined direction. In this way, the mounting/demounting unit and the vacuum chamber are coupled to each other. In this state, the mounting/demounting unit is locked to the vacuum chamber by the lock mechanism. That is, the vacuum chamber can be raised and lowered in its state locked to the movable part of the lift unit.

With the mounting/demounting unit locked by the lock mechanism to the vacuum chamber, the ends of the tubing and wiring positioned with respect to the mounting/demounting unit are connected to the tubing connector and wiring terminals provided on the vacuum chamber. Thus, when the vacuum chamber is mounted on the movable part of the vacuum chamber lift unit, the preparations of the vacuum chamber for the casting operation are automatically completed.

For removing the vacuum chamber from the movable part of the vacuum chamber lift unit, the lock by the lock mechanism is released, and then the movable part of the vacuum chamber lift unit is raised. As a result, the vacuum chamber is detached from the mounting/demounting unit of the movable part of the vacuum chamber lift unit and is removed from the movable part. In addition, the connection of the tubing connector and wiring terminals on the vacuum chamber and the ends of the tubing and wiring positioned relative to the mounting/demounting unit is automatically released. Thus, the mounting and demounting of the vacuum chamber with respect to the movable part of the vacuum chamber lift unit can be effected automatically by causing the raising or lowering of the movable part of the mounting/demounting unit and the operation of the lock mechanism. In this way, the vacuum chamber can be readily replaced.

Now, an upper structure of the vacuum chamber 14 will be described with reference to FIG. 7. Inside the vacuum chamber 14, a pair of electrodes (not shown) for molten metal leakage detection are disposed. Leads 144 of the pair electrodes are mounted in the top wall 14*u* of the vacuum chamber 14 via insulators 145. Terminals 144*t* connected to ends of the leads 144 are secured to the upper end of the insulators 145. Pins 147 extend upright from the top wall 14*u* of the vacuum chamber 14 at opposite ends thereof, and they each have a conical free end. The conical free end portion of each pin 147 has a recess (not shown), in which a lock bar 341*b* of a lock mechanism 341 to be described later is inserted.

A vacuum chamber mounting/demounting unit 34 serves to couple the vacuum chamber lift unit 30 to the vacuum chamber 14, and it includes a case 340 open at the bottom. The unit 34 also includes a horizontal intermediate plate 340*n* mounted in the case 340 at a predetermined height from the lower end. The intermediate plate 340*n* has positioning holes 347 corresponding in number to the number of and engaging with the pins 147. Thus, with the pins 147 of the vacuum chamber 14 inserted in the positioning holes 347 of the intermediate plate 340*n*, the vacuum chamber mounting/demounting unit 34 is in contact with the top wall 14*u* of the vacuum chamber 14 at a predetermined position thereof at all times.

To the intermediate plate 340*n* are secured lock mechanisms 341 corresponding in number to the number of pins 147 secured to the vacuum chamber 14. Each lock mechanism 341 includes a lock cylinder 341*a* and a lock bar 341*b* corresponding to the piston rod of the lock cylinder 341*a*. The lock bar 341*b* extends at right angles to each pin 147 on the vacuum chamber 14. When each lock cylinder 341*a* is driven to extend the lock bar 341*b* with the pins 147 inserted in the positioning holes 347 of the intermediate plate 340*n*, the free end of the associated lock bar 341*b* is engaged in the recess of each pin 147. As a result, the pins 147 are locked in the positioning holes 347 of the intermediate plate 340*n*, that is, the vacuum chamber 14 is locked to the vacuum chamber mounting/demounting unit 34.

Further, an end of the evacuation tubing 50 communicating the a vacuum pump (not shown) is positioned on the vacuum chamber mounting/demounting unit 34.

The evacuation tubing 50 is flexible, and a flanged short steel tube 52 is connected to the other end of the evacuation tubing 50. The flanged short steel tube 52 is inserted in a through hole 342 formed in the intermediate plate 340*n*. Around the flanged short steel tube 52 is disposed a coil spring 54 to bias a flange 52*f* of the short steel tube 52 away from the intermediate plate 340*n*. The through hole 342 in which the flanged short steel tube 52 is inserted, is formed such that it is concentric with an evacuation port 142 of the vacuum chamber 14 with the pins 147 thereof inserted in the positioning holes 347 of the intermediate plate 340*n*.

With this structure, when the vacuum chamber mounting/demounting unit 34 is locked to the vacuum chamber 14, the flange 52*f* of the flanged short steel tube 52 is urged by the spring force of the coil spring 54 against the top wall 14*u* of the vacuum chamber 14, whereby the evacuation tubing 50 is connected to the evacuation port 142 of the vacuum chamber 14.

An 0-ring 52*p* is fitted in the bottom surface of the flange 52*f* to ensure the seal of the evacuation tubing 50 with the flange 52*f* urged against the top wall 14*u* of the vacuum chamber 14.

Further, on the vacuum chamber mounting-/demounting unit 34 is positioned an end of a pressure lead duct 60 to lead the pressure in the vacuum chamber 14 to a pressure sensor (not shown). The pressure lead duct 60 is again a flexible tubing, and a flanged short tube 62 is connected to the other end of the duct 60. The flanged short tube 62 is inserted in a through hole 343 formed in the intermediate plate 340*n*. Around the flanged short tube 62 is provided a coil spring 64 to bias a flange 62*f* of the short tube 62 away from the intermediate plate 340*n*. The through hole 343 in which the flanged short tube 62 is inserted, is formed such that it is concentric with a pressure detection hole 143 of the vacuum chamber 14 with the pins 147 thereof inserted in the positioning holes 347 of the intermediate plate 340*n*.

With this structure, when the vacuum chamber mounting/demounting unit 34 is coupled to the vacuum chamber 14, the flange 62*f* of the flanged short tube 62 is urged against the top wall 14*u* of the vacuum chamber 14, and the pressure lead duct 60 is connected to the pressure detection hole 143 of the vacuum chamber 14.

An 0-ring 62*p* is mounted in the bottom surface of the flange 62*f*, thus securing the seal of the pressure lead duct 60 with the flange 62*f* urged against the top wall 14*u* of the vacuum chamber 14.

Further, on the vacuum chamber mounting-/demounting unit 34 is positioned an end of wiring 344 to lead an electric signal to a molten metal sensor gauge (not shown). To the end of the wiring 344 is connected a leaf spring having a V-shaped molding part 344*v*. This leaf spring is mounted in the intermediate plate 340*n* via an insulating support member 345. The insulating support member 345 mounted on the intermediate plate 340*n* is aligned to the insulator 145 of the vacuum chamber 14 with the pins 147 of the vacuum chamber 14 inserted in the positioning holes 347 of the intermediate plate 340*n*.

With this structure, when the vacuum chamber mounting/demounting unit 34 is coupled to the vacuum chamber 14, the V-shaped molding part 344*v* of the leaf spring is urged against the terminals 144*t* on the top wall 14*u* of the vacuum chamber 14. In this way, the molten metal leakage detection electrodes inside the vacuum chamber 14 is electrically connected to the gauge outside the vacuum chamber 14.

The top wall 340*u* of the case 340 of the vacuum chamber mounting/demounting unit 34 is coupled to a case support plate 340*k* via a floating mechanism which comprises bolts and nuts 340*b* and coil springs 340*p*. The case support plate 340*k* is rigidly bolted to an end of a piston rod 32*p* of a vacuum chamber lift cylinder 32.

The piston rod 32*p* of the vacuum chamber lift cylinder 32 and the case support plate 340*k* constitute the movable part of the vacuum chamber lift unit.

Now, the operation of the low pressure casting apparatus according to the first embodiment will be described.

First, the vacuum chamber 14 alone is transported by the feed-in unit 2 to the positioning unit 4 to be positioned at the center thereof. When the vacuum chamber 14 is positioned, the vacuum chamber lift cylinder 32 in the vacuum chamber lift unit 30 is driven to extend the piston rod 32*p* so as to lower the vacuum chamber mounting/demounting unit 34. During lowering of the vacuum chamber mounting/demounting unit 34, the pins 147 mounted on the top wall 14*u* of the vacuum chamber 14 are inserted in the positioning holes 347 of the intermediate plate 340*n*. As a result, the vacuum chamber mounting/demounting unit 34 is guided along the pins 147 and brought into contact with the top wall 14*u* of the vacuum chamber 14 at a predetermined position thereof.

The vacuum chamber mounting/demounting unit 34 is mounted via the floating mechanism on the vacuum chamber lift cylinder 32, and the pins 147 of the vacuum chamber 14 each have a conical free end portion. Thus, even if the axes of the pins 147 are slightly deviated from the centers of the positioning holes 347 of the vacuum chamber mounting/demounting unit 34, the vacuum chamber mounting/demounting unit 34 is displaced after the pins 147 and is thus set correctly on the top wall 14*u* of the vacuum chamber 14 at a predetermined position thereof.

When the vacuum chamber mounting/demounting unit 34 is engaged with the top wall 14*u* of the vacuum chamber 14, the lock mechanisms 341 of the vacuum chamber mounting/demounting unit 34 are driven to insert the free end of the lock bars 341*b* into the recess in the pins 147 of the vacuum chamber 14. Thus, the vacuum chamber mounting/demounting unit 34 and the vacuum chamber 14 are coupled to each other. Further, with the coupling of the vacuum chamber mounting-/demounting unit 34 and the chamber 14, the flanged short tube 52 of the evacuation tubing 50 positioned with respect to the vacuum chamber mounting-/demounting unit 34 is automatically connected to the evacuation port 142 of the vacuum chamber 14. At the same time, the flanged short tube 62 of the pressure lead duct 60 is automatically connected to the pressure detection hole 143 of the vacuum chamber 14. Further, the V-shaped molding part of the molten metal leakage sensor wiring 344 is brought into contact with the terminals 144*t* of the vacuum chamber 14. As is seen, by lowering the vacuum chamber mounting/demounting unit 34 into contact with the top wall 14*u* of the vacuum chamber 14 at a predetermined position thereof and driving the lock mechanisms 341, the vacuum chamber 14 is automatically mounted on the vacuum chamber lift unit 30.

When the vacuum chamber 14 is mounted on the vacuum chamber lift unit 30, the vacuum chamber lift cylinder 32 is driven to accommodate the piston rod 32*p*, thus raising the vacuum chamber mounting-/demounting unit 34 and the vacuum chamber 14 to a predetermined level. In this state, the feed-in unit 2 is driven again, whereby the surface plate 16 with the casting die 12 mounted thereon is brought to the positioning unit 4 to be positioned at the center thereof. This state is shown in FIG. 1.

Then, the vacuum chamber lift cylinder 32 is driven to extend the piston rod 32*p* so as to lower the vacuum chamber 14 to a position to surround the casting die 12. That is, the lower end of the vacuum chamber 14 is brought into contact with the surface plate 16. In this state, the inner space of the vacuum chamber 14 is held hermetical. Since the vacuum chamber mounting-/demounting unit 34 is provided with the floating mechanism as noted above, the vacuum chamber 14 is made hermetical more effectively.

Then, the lift cylinder 8 supporting the positioning unit 4 is driven to accommodate the piston rod 8*p* to lower the positioning unit 4 down to a predetermined level. The surface plate 16, the casting die 12 and the vacuum chamber 14 are thus lowered in unison with one another, and the lower end of the stalk 20 set in the surface plate 16 is immersed in the molten metal in the melting furnace 18.

When the lower end of the stalk 20 is immersed in the molten metal in the melting furnace 18. The vacuum chamber 14 is evacuated by the vacuum pump via the evacuation tubing 50. Thus, the cavity in the casting die 12 disposed inside the vacuum chamber 14 is indirectly evacuated, and molten metal in the melting furnace 18 is sucked into the cavity through the stalk 20. The evacuation of the inner space of the vacuum chamber 14 is subsequently continued until the molten metal charged into the cavity is solidified in order to provide for a push molten metal effect. When the molten metal in the casting die 12 is solidified in this state after a predetermined solidification time, the vacuum chamber 14 is open to atmosphere, and non-solidified molten metal found in the sprue and also in the stalk 20 is returned to the melting furnace 18, thus bringing an end to the casting. During casting, the pressure in the vacuum chamber 14 is monitored, and also molten metal leakage is checked for.

When the casting is ended, the lift cylinder 8 is driven to extend the piston rod 8*p* so as to raise the positioning unit 4 up to the level of the feed-in and feed-out units 2 and 6, and further the vacuum chamber lift cylinder 32 is driven to accommodate the piston rod 32*p* so as to raise the vacuum chamber 14 up to a predetermined level. Then, the surface plate 16 and the casting die 12 used for the casting are carried out by the feed-out unit 6.

Further, if it becomes necessary to inspect or repair the vacuum chamber 14, the lock mechanisms 341 of the vacuum chamber mounting/demounting unit 34 are operated to remove the lock bars 341*b* from the recess of the pins 147 of the vacuum chamber 14, whereby the coupling between the vacuum chamber mounting-/demounting unit 34 and the vacuum chamber 14 is released. In this state, the pins 147 of the vacuum chamber 14 are taken out of the positioning holes 346 of the intermediate plate 340*n* of the vacuum chamber mounting/demounting unit 34 to separate the vacuum chamber 14 and the vacuum chamber mounting/demounting unit 34 from each other.

In this state, the vacuum chamber 14 is fed out together with the surface plate 16 and the casting die 12 with the feed-out unit 6 to the outside of the line for inspection or repair.

In the above way, by operating the vacuum chamber lift unit 30 and the lock mechanisms 341, the vacuum chamber 14 can be automatically mounted and demounted, and thus it can be readily replaced. In addition, by preparing a plurality of vacuum chambers as the vacuum chamber 14, the replacement thereof may be done without stopping the casting line.

In this embodiment, the vacuum chamber 14 can be automatically mounted and demounted with respect to the movable part of the vacuum chamber lift unit 30 with the movable part raised and lowered by operating the lock mechanisms. Thus, the vacuum chamber 14 can be readily replaced to facilitate its inspection and repair when it is damaged due to leakage of molten metal or the like.

In the prior art low pressure casting apparatus, the combustion gas noted above is led together with the gas in the vacuum chamber to the vacuum unit, thus resulting in deposition of fatty combustion product contained in the combustion gas on apparatus protection filter provided in the vacuum unit. Therefore, in a mass production line for performing a large number of casting cycles, with increase of the casting cycles, the ventilation resistance of the filter is increased to reduce the efficiency of evacuation of the hermetic chamber. Periodic filter replacement is thus necessary.

Combustion gas containing fatty combustion product flows directly through valves and evacuation tubing which are provided between the surface plate and the apparatus protection filter, and therefore the fatty combustion product is attached to the inner wall surfaces of these intermediate parts. The fatty combustion product attached to the valves and evacuation tubing is very difficult to remove. Therefore, irrespective of the periodic filter replacement, the ventilation resistance of the evacuation system is increased in long use, thus resulting in the reduction of the casting rate or generation of casting defects due to defective supply of molten metal. The embodiment which is now to be described, copes with this problem.

Figure 7:
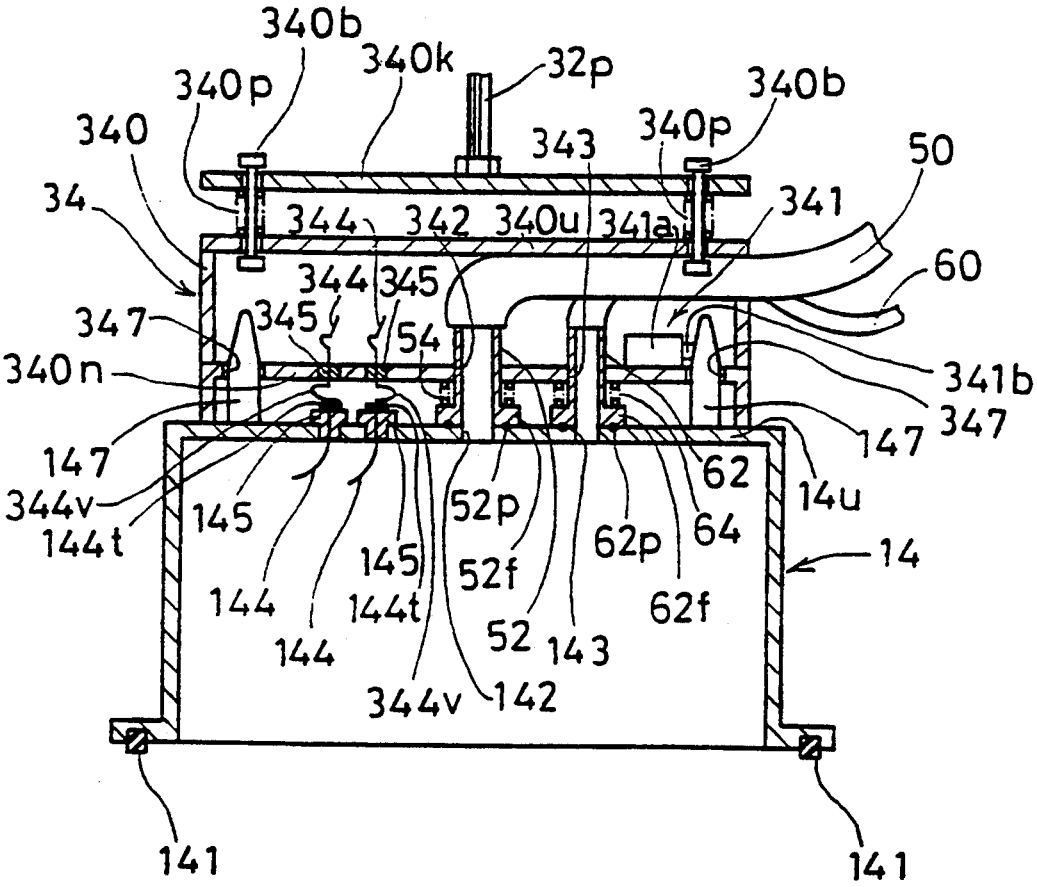
FIG. 7 is a detailed sectional view showing a vacuum chamber and a vacuum chamber mounting/demounting section.
Figure 8:
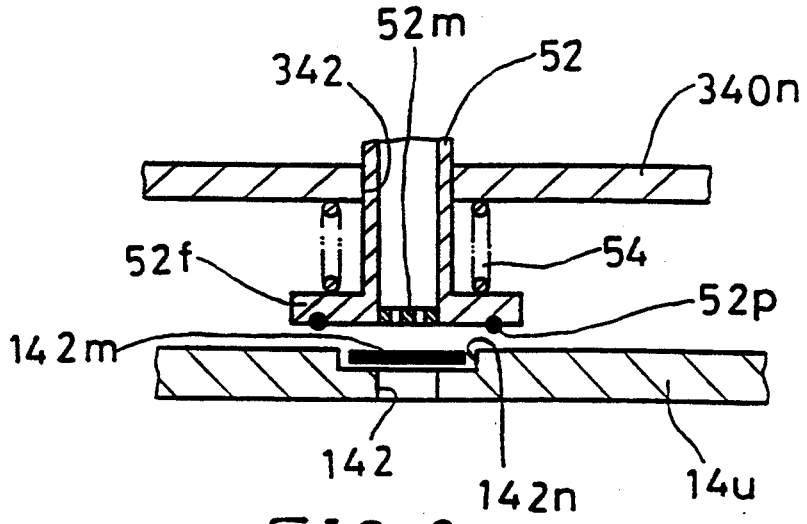
FIG. 8 is a detailed sectional view showing the essential parts of the chamber mounting/demounting section.

FIG. 8 shows details of the vacuum chamber mounting/demounting unit 34 used in this embodiment of the invention (which is slightly improved over that shown in FIG. 7).

In this embodiment, the flanged short tube 52 of the evacuation tubing 50 and the evacuation port 142 formed in the vacuum chamber 14 shown in FIG. 7 are modified such that a filter 142*m* can be mounted between the parts 52 and 142.

As shown in FIG. 8, the top wall 14*u* of the vacuum chamber 14 is formed with a circular recess 142*n* around and concentric with the evacuation port 142, and the filter 142*m*, which is disk-like in shape, can be accommodated in the circular recess 142*n*. In addition, a perforated filter retainer 52*m* is mounted in the end opening of the flanged short tube 52 on the side of flange 52*f*. With this structure, when the vacuum chamber 14 is coupled to the vacuum chamber mounting-/demounting unit 34 with the filter 142*m* accommodated in the recess 142*n*, the evacuation tubing 50 is communicated with the inner space of the vacuum chamber 14 via the filter 142*m*. Thus, suit and resin component contained in the combustion gas generated from the casting die during casting is prevent from flowing into the vacuum pump, etc., and thus the life of the equipment can be extended.

Further, the replacement of the filter 142*m* can be done together with the replacement of the vacuum chamber 14 and thus is not time-consuming.

Figure 9:
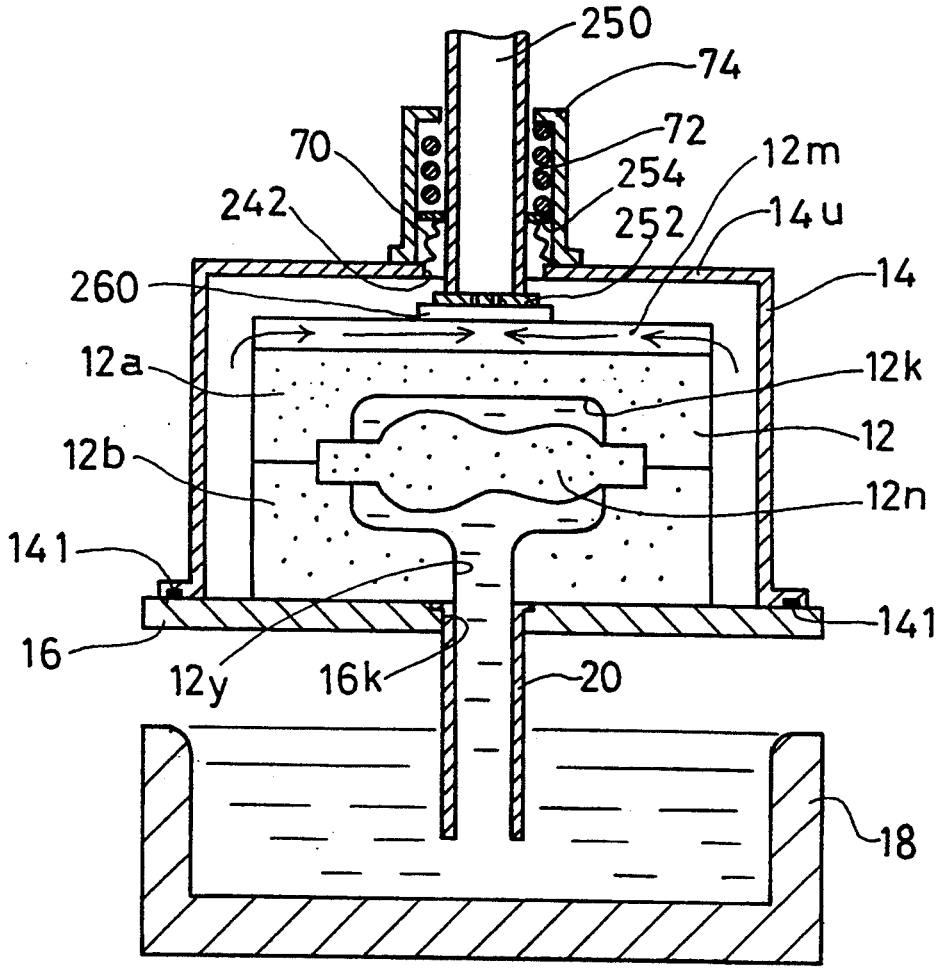
FIG. 9 is a sectional view showing a low pressure casting apparatus according to another embodiment of the invention.
Figure 10A:
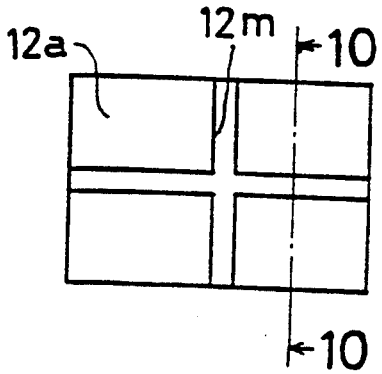
FIGS. 10(A) and 10(B) are a plan view and a sectional view, respectively, showing a casting die.
Figure 10B:
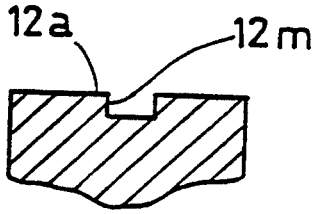
Figure 11:
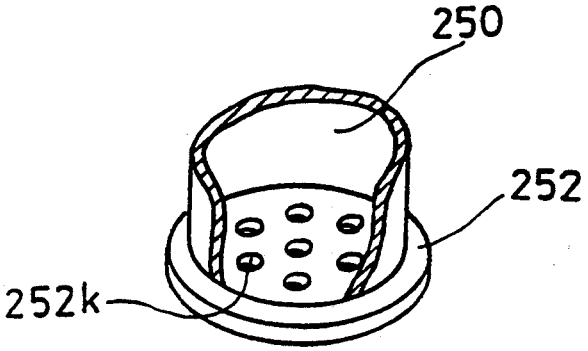
FIG. 11 is a perspective view, partly broken away, showing an evacuation tubing.

Another embodiment of the low pressure casting apparatus will now be described with reference to FIGS. 9 to 11. FIG. 9 is a fragmentary sectional view showing the low pressure casting apparatus according to this embodiment. FIGS. 10(A) and 10(B) show a casting die in detail, and FIG. 11 shows the end of an evacuation tubing in detail. Parts that are the same as those in the first embodiment are given like reference numbers, and their description will not be repeated.

As shown in FIG. 9, the vacuum chamber 14 is a vessel open at the bottom, and a seal member 141 is fitted to the bottom of the vacuum chamber 14 surrounding the bottom opening thereof. With the vacuum chamber 14 mounted on the surface plate 16, the inner space of the vacuum chamber 14 is held hermetical. The top wall 14*u* of the vacuum chamber 14 has a central evacuation port 242 in which an end of evacuation tubing 250 communicated with a vacuum pump (not shown) is inserted.

As shown in FIG. 11, a filter retainer 252 is mounted in the end opening of the evacuation tubing 250. The filter retainer 250 serves to keep a filter 260 to be described later from above, and it has a plurality of through holes 252*k* for low pressure gas passing through the filter 260.

Further, as shown in FIG. 9, the evacuation tubing 250 has a flange 254 located a predetermined dimension above its free end face, and a bellows 70 is mounted between the flange 254 and the evacuation port 242 of the vacuum chamber 14. The bellows 70 provides a seal between the evacuation port 242 and the evacuation tubing 50, while permitting vertical displacement of the evacuation tubing 250 relative to the vacuum chamber 14. A coil spring 72 is provided around the evacuation tubing 250 with its lower end supported by the flange 254. A cylindrical spring retainer 74 is provided around the coil spring 72 and the bellows 70, with its lower end flange secured to the top wall 14*u* of the vacuum chamber 14. The top wall 14*u* of the spring retainer 74 is like an inner flange which urges the upper end of the coil spring 72 downward. With this structure, the free end of the evacuation tubing 50 projects inward into the vacuum chamber 14 from the ceiling thereof to a predetermined extent due to the spring force of the coil spring 72. That is, the filter retainer 252 at the free end of the evacuation tubing 250 is positioned in the vacuum chamber 14 at a prescribed position.

The casting die 12 is made of sand bond by a binder and is gas permeable, and it comprises an upper and a lower die half 12*a* and 12*b*. With the die halves 12*a* and 12*b* assembled together, an inner cavity 12*k* is formed. A sand core 12*n* is disposed and positioned at a prescribed position in the cavity 12*k* to define the shape of the casting.

As shown in FIG. 10(A), the top surface of the casting die 12 (i.e., the top surface of the die half 12*a*) is formed with a cross-shaped groove 12*m*, and the disk-like filter 260, which is made of glass fibers, is positioned on the center of the top surface of the casting die 12, i.e., the portion of intersection of the grooves 12*m*.

Thus, with the vacuum chamber 14 regularly fitted on the casting die 12, the filter retainer 252 of the evacuation tubing 250 mounted on the vacuum chamber 14 is in contact with the top surface of the filter 260, and the filter 260 is urged downward by the spring force of the spring 72. The filter 260 is thus clamped between the top of the casting die 12 and the filter retainer 252, and thus the end opening of the evacuation tubing 250 (i.e., the through holes 252*k* of the filter retainer 252) is covered by the filter 260.

With this arrangement, when evacuating the inside of the vacuum chamber 14, the gas therein is sucked through the grooves 12*m* in the casting die 12 and the filter 260 into the evacuation tubing 50.

Now, the operation of the low pressure casting apparatus according to this embodiment will be described.

First, the stalk 20 is set in through hole 16*k* of the surface plate 16, and the casting die 12 is mounted on the surface plate 16 such that the sprue 12*y* of the die 12 is communicated with the top of the stalk 20. Further, the disk-like filter 260 is positioned on the top center of the casting die 12. In this state, the surface plate 16, the casting die 12, etc. are fed by the feed-in unit 2 onto and positioned at the center of the positioning unit 4.

Then, the vacuum chamber lift unit 30 is driven to lower the vacuum chamber 14 and thus fit the vacuum chamber 14 on the casting die 12. With the lower end of the vacuum chamber 14 thus brought into contact with the surface plate 16, the inner space of the vacuum chamber 14 is made and held hermetical. Further, the filter retainer 252 of the evacuation tubing 250 mounted on the hermetical vacuum chamber 14 is urged against the filter 260 on the casting die 12, thus clamping the filter 260 between the top of the casting die 12 and the filter retainer 252. The through holes 252*k* of the filter retainer 252 at the end of the evacuation tubing 50 are thus covered by the filter 260.

Subsequently, the lift cylinder 8 supporting the positioning unit 4 is driven to accommodate the piston rod 8*p* to lower the positioning unit 4 down to a predetermined level. That is, the surface plate 16, the casting die 12 and the vacuum chamber 14 are lowered in unison with one another to immerse the lower end of the stalk 20 set in the surface plate 16 into molten metal in the melting furnace 18.

When the lower end of the stalk 20 is immersed in molten metal in the melting furnace 18, the inner space of the vacuum chamber 14 is evacuated by the vacuum pump via the evacuation tubing 50. Consequently, the cavity 12*k* of the casting die 12 disposed in the hermetical vacuum chamber 14 is indirectly evacuated, thus causing molten metal in the melting furnace 18 to be sucked through the stalk 20 into the cavity 12*k*. After molten metal thus has been charged into the cavity 12*k*, the evacuation of the vaccuum chamber 14 is continued until the charged molten metal is solidified in order to provide the effect of pushing molten metal. When the inner space of the hermetical vacuum chamber 14 is made vacuum, the gas therein is led through the grooves 12*m* in the casting die 12, the filter 260 and the evacuation tubing 50 into the vacuum pump. At this time, the fatty combustion product contained in the combustion gas generated in the casting die 12 is filtered out by the filter 260 and does not enter the evacuation tubing 250. Thus, the evacuation tubing 250 and vacuum pump can be held clean. Further, since the grooves 12*m* in the casting die 12 are in the form of a cross, the gas around the casting die 12 can be sucked uniformly into the evacuation tubing 250. Thus, gas defects due to lack of uniformity of evacuation can be eliminated, and also the fatty combustion product contained in the combustion gas can be efficiently collected in the filter 260.

If the grooves 12*m* are not formed in the top surface of the casting die 12, the entire bottom surface of the filter 260 are in contact with the top surface of the die 12. In this case, the low pressure force from the evacuation tubing 50 acts on the cavity 12*k* through the filter 260 and the gas permeable casting die 12 for evacuation of the cavity 12*k*. In consequence, a gas stream is generated in the cavity 12*k* in a particular direction. This gas stream generated in the cavity 12*k* causes trapping of gas in molten metal sucked into the cavity 12*k*.

With the grooves 12*m* provided underneath the filter 260 in this embodiment, the gas in the inner space of the vacuum chamber 14, i.e., the gas around the casting die 12, is led through the grooves 12*m*, and the low pressure force from the evacuation tubing 250 acts on the entire outer surface of the casting die 12. Thus, no gas stream in any particular direction is generated in the cavity 12*k*, thus eliminating the trapping of gas in the molten metal sucked into the cavity 12*k* and improving the quality of casting.

When the vacuum chamber 14 is evacuated for a predetermined period of solidification time to solidify the molten metal in the casting die 12, the hermetical chamber box 14 is opened to atmosphere, and non-solidified molten metal remaining in the sprue 12*y* and the stalk 20 is returned to the melting furnace 18, thus bringing an end to the casting.

When the casting is ended, the lift cylinder 8 is driven to extend the piston rod 8*p* so as to raise the positioning unit 4 up to the level of the feed-in and -out units 2 and 6. Further, the vacuum chamber lift unit 30 is driven to raise the vacuum chamber 14 up to a predetermined level. With the raising of the hermetical vacuum chamber 14, the filter 260, which has been only clamped between the top surface of the casting die 12 and the filter retainer 252 of the evacuation tubing 50, is automatically released by the filter retainer 252 to remain held on the top surface of the casting die 12.

Subsequently, the casting die 12, the surface plate 16, and the used-up filter 260 which have been used for the above casting, are fed out for the die removal. The casting die 12 is then opened at a predetermined position, and the product is taken out. The used-up filter 260 is discarded.

In the above embodiment, the filter retainer 252 of the evacuation tubing 250 urged the filter 260 with the spring force of the coil spring 72. However, it is possible as well to use an air cylinder or the like for urging the filter 260.

Further, while in the above embodiment the grooves 12*m* in the top surface of the casting die 12 were arranged in the form of a cross, this arrangement is by no means limitative; for instance, it is possible to increase the number of grooves 12*m* in a radial arrangement by taking the flow of gas in the vacuum chamber 14 into considerations.

Further, while in the above embodiment the filter 260 was made of glass fibers, it is not required to be highly durable because it is replaced whenever the casting die 12 is replaced. Thus, it is possible to select other materials for the filter from the economical standpoint.

According to the invention, the gas in the vacuum chamber is led through the filter to the evacuation system to prevent fatty combustion product contained in combustion gas from entering the evacuation system, and it is thus possible to hold the evacuation system clean. In addition, once the filter is positioned in the casting die at a prescribed position thereof, it can be subsequently automatically mounted in the end opening of the evacuation tubing. Thus, the filter replacement can be made together with the casting die replacement, and it is thus possible to obtain stable and continuous low pressue casting in a mass production line.

Further, since the gas in the vacuum chamber is led through the grooves in the casting die top surface to the evacuation system, the low pressue force from the evacuation system acts uniformly on the outer surface of the gas permeable casting die, and no gas stream in any particular direction is generated in the cavity. Thus, no gas is trapped in molten metal sucked into the cavity, and it is possible to improve the quality of casting.

What is claimed is:

1. A low pressue casting apparatus comprising a gas permeable casting die, a vacuum chamber and a surface plate having a die mounting area and a vacuum chamber mounting area for supporting said casting die and said vacuum chamber, said surface plate being formed with a through hole for inserting a stalk therethrough, the top surface of said surface plate being formed with grooves extending from said through hole to an area between said die mounting area and said vacuum chamber mounting area.

2. The suction casting apparatus according to claim 1, wherein said grooves extends in the form of a cross centered on said through hole.

3. The suction casting apparatus according to claim 1, wherein said surface plate has a recess surrounding said through hole and communicating with said grooves.

4. The suction casting apparatus according to claim 1, wherein said grooves are open outward.

5. A low pressure casting apparatus comprising a gas permeable casting die, a vacuum chamber and a surface plate having a through hole for inserting a stalk therethrough, a die mounting area, and a vacuum chamber mounting area, the bottom surface of said casting die being formed with grooves extending from said through hole to an area between said die mounting area and said vacuum chamber mounting area.

* * * * *